United States Patent [19]

Fujiwara et al.

[11] 4,328,747

[45] May 11, 1982

[54] CHARACTER RING-SELECTING TYPE PRINTER

[75] Inventors: Hitoshi Fujiwara; Yousei Kawabata, both of Shiojiri, Japan

[73] Assignees: Kabushiki Kaisha Suwa Seikosha, Tokyo; Shinshu Seiki Kabushiki Kaisha, Nagano, both of Japan

[21] Appl. No.: 131,561

[22] Filed: Mar. 19, 1980

[30] Foreign Application Priority Data

Mar. 23, 1979 [JP] Japan ..... 54-37562

[51] Int. Cl.[3] ..... B41J 1/16

[52] U.S. Cl. ..... 101/93.17; 101/93.09; 101/93.24

[58] Field of Search ..... 101/99, 93.09, 93.15, 101/93.17, 93.18

[56] References Cited

U.S. PATENT DOCUMENTS

| | | | |
|---|---|---|---|
| 3,374,873 | 3/1968 | Takenaka . | |
| 3,385,213 | 5/1968 | Stephan | 101/99 X |
| 3,707,122 | 12/1972 | Cargill | 101/93.34 |
| 3,850,097 | 11/1974 | Sweeney . | |
| 3,990,361 | 11/1976 | Matsubara | 101/93.09 |
| 4,033,256 | 7/1977 | Hanaoka | 101/99 |
| 4,161,912 | 7/1979 | Usui et al. | 101/99 |
| 4,230,039 | 10/1980 | Mizutani et al. | 101/93.17 |
| 4,244,291 | 1/1981 | Kodaira et al. | 101/93.17 X |

FOREIGN PATENT DOCUMENTS

| | | | |
|---|---|---|---|
| 2830226 | 2/1979 | Fed. Rep. of Germany | 101/93.09 |

*Primary Examiner*—Clifford D. Crowder

*Attorney, Agent, or Firm*—Blum, Kaplan, Friedman, Silberman and Beran

[57] ABSTRACT

A character ring-selecting type printer for printing m laterally spaced columns includes less than m character rings with lateral spacing between adjacent character rings. The character rings are translated in unison to enable one character ring to print in more than one column.

14 Claims, 10 Drawing Figures

FIG. 5a
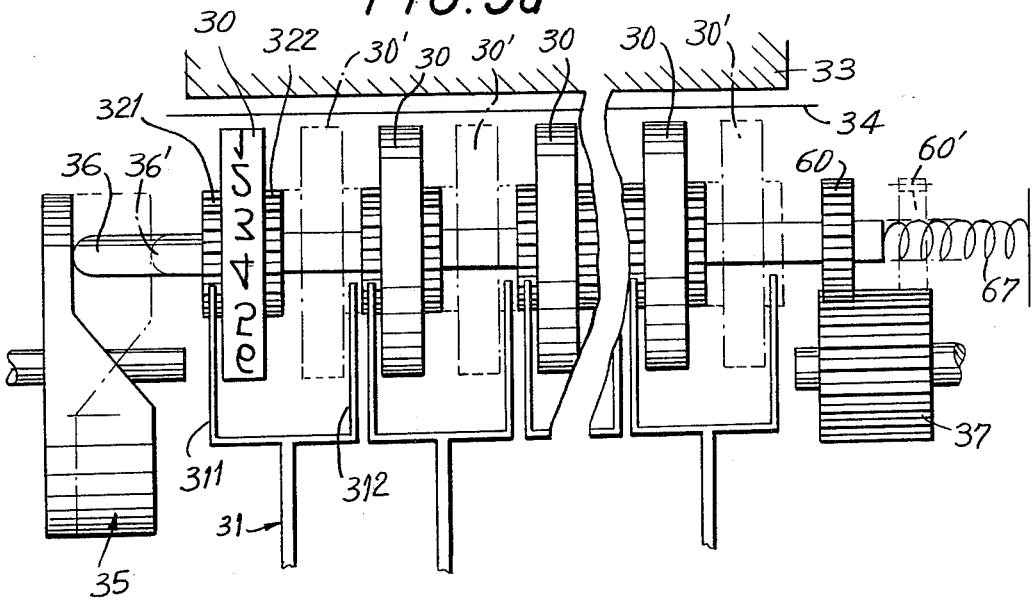
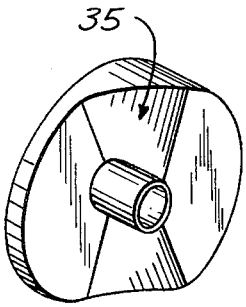
FIG. 5b
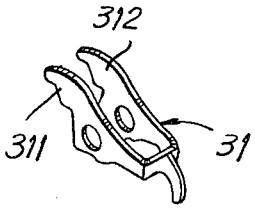
FIG. 5c

CHARACTER RING-SELECTING TYPE PRINTER

BACKGROUND OF THE INVENTION

This invention relates generally to a character ring-selecting type printer of the type used to print lines of characters in laterally spaced columns on printing paper and, more particularly, to a character ring-selecting type printer where the number of character rings is less than the number of laterally spaced columns which may be printed. Conventional printers of the prior art tend to be large in size, noisy in operation, and difficult to miniaturize without the need for highly precision formed parts. The noise of operation and size of the printers reduces the number of locations where the printers may be conveniently used, and the requirements for precision in manufacture greatly increase the cost.

What is needed is a character ring-selecting type printer which can be miniaturized with a minimum need for high precision components in manufacture and which is quiet in operation.

SUMMARY OF THE INVENTION

Generally speaking, in accordance with the invention, a character ring-selecting type printer especially suited for low noise operation and having a reduced number of precision formed parts is provided. The character ring-selecting type printer prints m laterally spaced columns and includes less than m character rings which are mounted with lateral spacing between ajacent character rings. The character rings are translated in unison to enable one character ring to print in more than one column. The number of character rings equals half of the number of printed columns when the cam provides translation equal to the spacing between printed columns. The gap between adjacent character rings permits a construction which may be less precise than the construction required where adjacent character rings must be substantially in contact.

Accordingly, it is an object of this invention to provide an improved character ring-selecting type printer having space between adjacent character rings so that less precision is required in manufacture.

Another object of this invention is to provide an improved character ring-selecting type printer which has less character rings than the number of columns which can be printed.

A further object of this invention is to provide an improved type printer which is quiet in operation and can be miniaturized.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5*a* is a partial view of a character ring-selecting type printer in accordance with this invention;

FIG. 5*b* is a perspective view of a cam used in the printer of FIG. 5*a*;

FIG. 5*c* is a perspective view of a selective pawl used in the printer of FIG. 5*a*;

DESCRIPTION OF THE PREFERRED EMBODIMENTS

Figure 1:
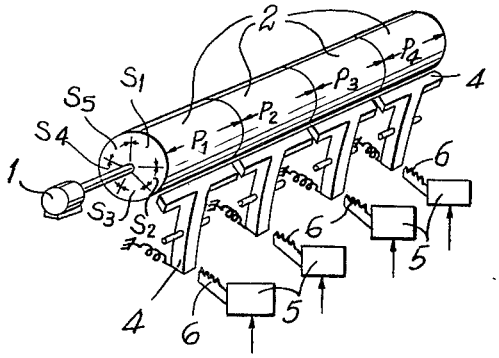
FIG. 1 PRIOR ART
FIG. 1 is a perspective view of an impact type drum printer of the prior art wherein each hammer is used to print a plurality of columns.
Figure 2:
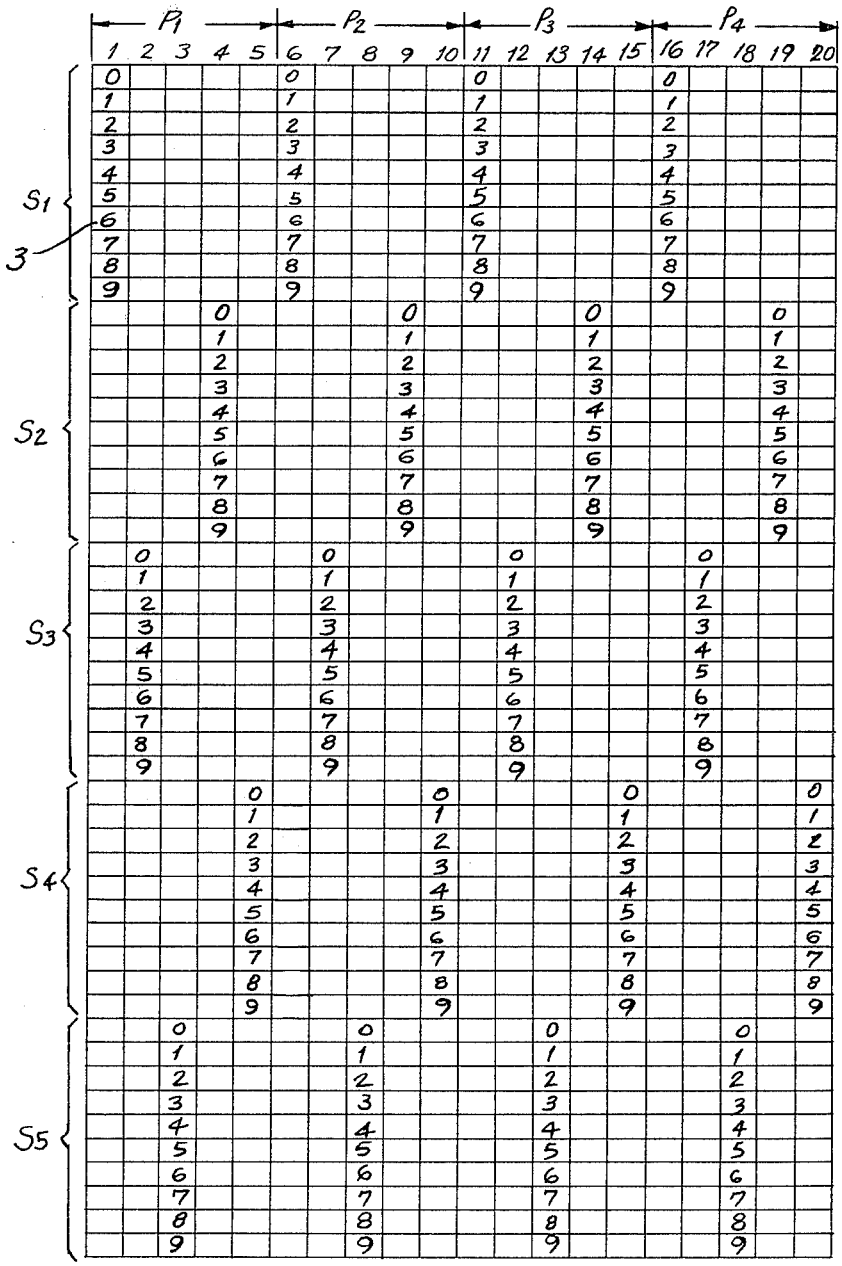
FIG. 2 PRIOR ART
FIG. 2 is a view showing the character locations on the character drums of the printer of FIG. 1.

First, several conventional printers are described. Referring to the figures, FIG. 1 shows a flying type drum printer of the prior art wherein characters for five columns are printed using the same hammer 4 and the same character drum 2. There are four character drums and four hammers. On the outer peripheral surface of each character drum 2, characters 3 are provided, such as symbols, numerals, etc., for printing five columns, thereby providing for a total of twenty columns in the printer. Also, as shown in FIG. 2, in looking at the arrangement of characters 3, each character drum 2 is divided radially into five segments $S_1$ through $S_5$, and within each segment the characters 3 for printing only one column are located. Using this structure, only four hammers are needed for printing twenty columns, such that four electric coils 6 and four driving circuits 5 for independently driving hammers 4 are sufficient. However, a drum printer is generally not suitable for use in an office, in quiet places, etc., because the knocking sound made by the hammers 4 is loud and the printer is noisy. Further, with regard to the arrangement of characters 3 on the character drums 2, the diameter of the character drums 2 is large. It is difficult to miniaturize the printer of FIG. 1, and the energy required to drive the motor 1 must be high as compared to a miniaturized printer.

Figure 3A:
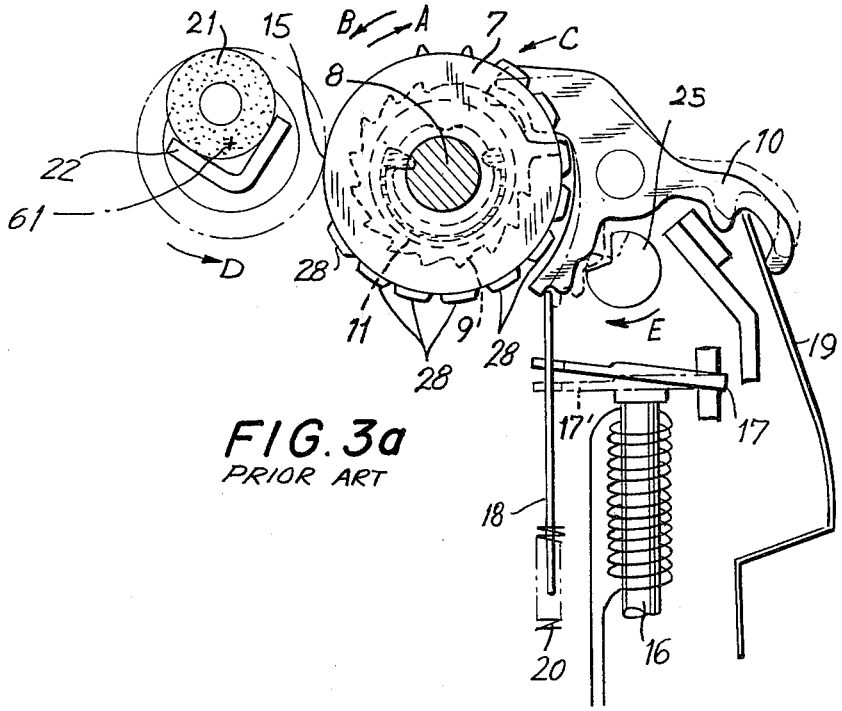
FIG. 3a PRIOR ART
FIGS. 3*a* and 3*b* are side elevational views, partially in section, of the printing mechanism of a character ring-selecting type printer of the prior art.
Figure 3B:
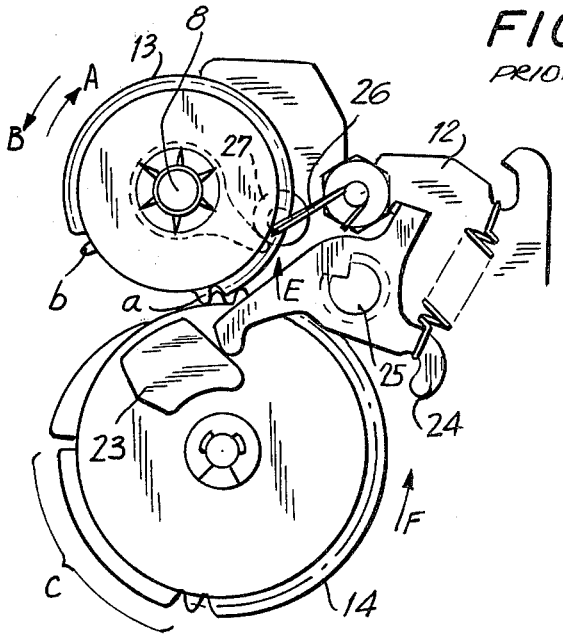
FIG. 3b PRIOR ART
Figure 4:
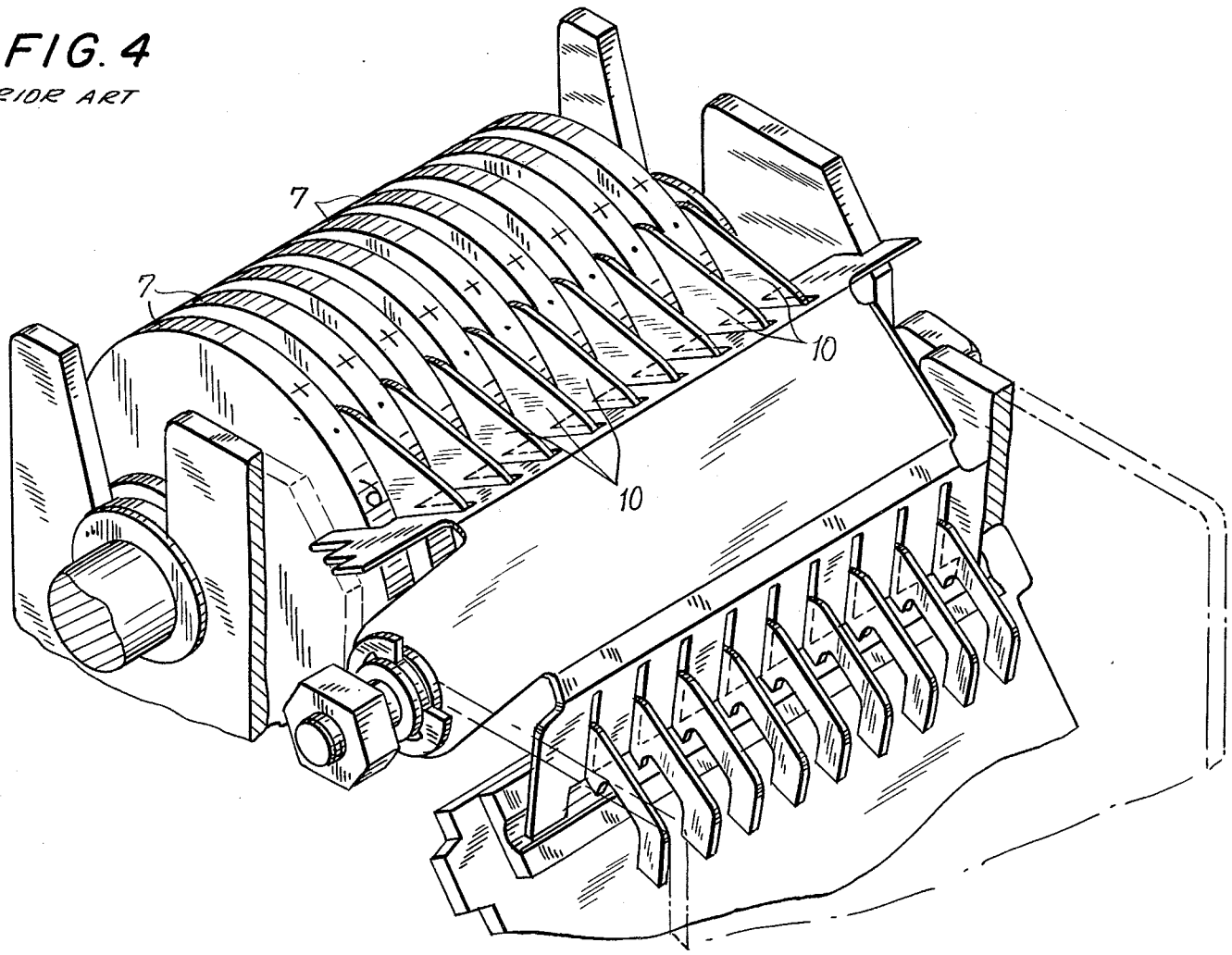
FIG. 4 PRIOR ART
FIG. 4 is a perspective view of the printer of FIGS. 3*a* and 3*b*.

Another conventional character ring-selecting type printer of the prior art is shown in FIGS. 3*a*, 3*b* and 4. FIG. 3*a* shows a cross section and view of a printing mechanism, and FIG. 3*b* shows a gear train for driving the printing process and the major elements in the restoring process. FIG. 4 is a simplified perspective view of this printer. Character ring 7 is mounted on a drive shaft 8 with each column being printed by an independent character ring 7, that is in contrast with the character drums 2 of FIG. 1, wherein a single drum accommodates a plurality of columns. The outer peripheral surface of each ring 7 is divided into sixteen circumferential parts and twelve parts are devoted to characters 28 and four parts are blank. On the side surface of each character ring 7 is positioned a ratchet wheel 9 having teeth corresponding in spacing to the twelve characters 28 and a selective pawl 10 is positioned for engagement with each ratchet wheel 9. Inside each character ring 7, a spring 11 is mounted having one end thereof engaged in a v-groove in the drive shaft 8 so as to hold the character rings 7 and the drive shaft 8 together as a unitary structure.

During the operation of selecting characters 28 for printing, each ring 7 rotates with the shaft 8 until selective actuation of each of the pawls 10 causes the pawls 10 to engage the associated ratchet wheel 9 and stop rotation of the associated character ring 7 with a selected character 28 in printing position. As the drive shaft 8 continues to rotate after engagement of the ratchet wheel 9, the spring 11 is driven out of the v-groove leaving the character ring 7 at its selected position. It should be understood that each character ring 7 associates with an individual pawl member 10, ratchet wheel 9, inner spring 11, etc., and operates in a similar manner.

A selective gear 13 (FIG. 3*b*) is mounted on a frame 12 which also supports the drive shaft 8. The selective gear 13 is only partially toothed and engages with an intermittent gear 14 to rotate the drive shaft 8 and the character ring 7 in a direction indicated by the arrow A in the drawing. On the outer periphery of the selective gear 13 is disposed a spring 26 (FIG. 3*b*) used for restoring the character ring 7 and drive shaft 8, after printing is completed, to the standby position where they were located before initiation of the process of selecting characters.

When an instruction for printing is given by control means (not shown), a motor (not shown) rotates the intermittent gear 14 in the direction indicated by the arrow F through a gear train (not shown). When the first tooth of the intermittent gear 14 and the first tooth a of the selective gear 13 become engaged with each other, the drive shaft 8 rotates with the character rings 7 in the direction of arrow A. In this process, the spring 26, for restoring the character ring 7 to a standby position, is wound up. Then the character selecting process begins and is carried out as described above. Before a character 28 which is to be printed comes to the printing position 15, that is, on a straight line which connects the center of the drive shaft 8 with the rotational center 61 of a platen roller 21, an electric current is passed through an electro-magnet 16 associated with the character ring 7 of the desired character 28 for printing. Then, an attraction plate 17 is drawn to the magnet 16 and a trigger bar 18 is pushed so as to disengage from the selective pawl 10. A plate 17′, drawn with broken lines, indicates the attracted position.

The selective pawl 10 is biased by the force of a selective spring 19 and is always primed for rotation in a direction indicated by the arrow C. The pawl 10 instantly pivots when released by the bar 18 so as to engage in a tooth of the ratchet wheel 9 corresponding to the character that is to be printed. The pawl 10 stops that particular associated character ring 7. When the trigger electro-magnet 16 is deenergized, the trigger bar 18 is pushed upward by the restoring force of a trigger bar spring 20 which was compressed by the prior motion of the attraction plate 17. However, as the selective pawl 10 remains engaged with the ratchet wheel 9, the trigger bar 18 cannot return to its initial position. Because the character ring 7 is held by the selective pawl 10 and ratchet 9, when the drive shaft 8 rotates further, the spring 11 is forced up from the v-groove of the drive shaft 8, as previously described, and rides on the periphery of the shaft 8. The drive shaft 8 comes to a stand-still when the last tooth of the selective gear 13 runs adjacent an untoothed sliding face c of the intermittent gear 14. At this time, the character 28 on the selected character ring that is to be printed is present at the printing position 15. Otherwise, when no character 28 on a ring 7 is selected, a blank portion of the ring 7 is present at the printing position 15.

A crank 22 rotatably supporting the platen roller 21 for motion about a center of rotation 61 is then rotated in the direction of arrow D through a gear train from the motor (not shown). When the character ring 7 comes to a stand-still and the characters 28 that are to be printed are all present at the printing position 15, the platen roller 21 is approaching the printing position 15. When the crank 22 is further rotated, the platen roller 21 rolls and presses a recording paper (not shown) against the selected character 28 through a ribbon (not shown) in the known manner.

Substantially at the same time as printing is finished, a reset lever 24 and a reset lever shaft 25, joined as one piece, are rotated in the direction of arrow E by a cam 23 disposed on a side surface of the intermittent gear 14. The selective pawl 10 rotates in the direction opposite of the arrow C to release from the ratchet 9 of the character ring 7. At this time, and for the first time, the trigger bar 18 is able to return to its initial position in engagement with the selective pawl 10. While the characters 28 are printed, the intermittent gear 14 continues to rotate. At the moment that the printing is completed, contact of the last tooth b on the selective gear 13 with the untoothed sliding face c of the intermittent gear 14 is broken. Thereby, the drive shaft 8 is free from control by the intermittent gear 14. Then, the character ring 7 rotates in the direction of the arrow B urged by the restoring force of the spring 26. Simultaneously, the end of spring 11 falls back into the v-groove on the drive shaft 8 and the character ring shaft 8 and the character ring 7 rotate once again as one integral structure. The selective gear 13, on the same shaft 8 as the character ring 7, strikes against a stop (not shown) positioned on the frame 12 whereby the character ring 7 stops at the standby position ready for the process of selecting the next character. Thus, the character ring restoring process has been described.

A printer with the above-described structure (FIGS. 3*a*, 3*b* and 4) has an advantage in that the noise emitted at the time of printing is of low level, because its characters are printed by a roller pressed against a character group which has been brought to rest. However, as shown in FIG. 4, the character rings 7 are close to each other. Further, the ratchet wheels 9 and the springs are disposed between each character ring 7. Such a printer design has the disadvantage that the action becomes sluggish and erratic when the manufacturing accuracy of each part varies, as will always be expected to some degree.

The printer, in accordance with this invention, is designed with consideration of the above-mentioned advantages and faults. It includes the best feature, i.e., quiet printing, that is found in a conventional printer of the type shown in FIGS. 3*a*, 3*b* and 4. The printer of this invention is not only useable in the office, in quiet surroundings, and the like, but also by being miniaturized can be applied to a personal electronic calculator operated by an individual. Because critical parts are fewer in number and spaced further apart, the printer of this invention is more economical to produce and more reliable in operation.

Embodiments of this invention are explained with reference to the figures as follows: FIG. 5*a* is a portion of a character ring-selecting type printer wherein only the circumferential portion, that is, an annular portion of the character ring 30 is laterally translated as explained more fully hereinafter. The selective mechanism and the electro-magnetic devices are not translated but are fixed at a definite position. FIG. 5*b* shows the shape of a cam 35 used in the printer of FIG. 5*a*, and FIG. 5*c* shows the shape of a selective pawl 31 used in the printer of FIG. 5*a*.

The construction, actions and timing of the printer in accordance with this invention are similar to those of the printer in FIGS. 3*a*, 3*b* and 4, except as particularly described. As described above, the individual character print rings 30 have numeric characters or symbols along the surface periphery thereof. A ratchet wheel 321 is located on one side of each character ring 30 and a ratchet wheel 322 is located on the other side of each character ring 30. The character rings 30 are connected to a shaft 36 by means of an inner spring and v-groove in the shaft 36 as described above. The shaft 36 is rotated by a motor (not shown) through a gear train comprised of a gear 37 driving a gear 60 which is fixedly attached to the shaft 36. For the printing of odd columns, that is columns 1, 3, 5, etc., of an array of columns, the character rings 30 are situated in the lateral positions indicated by the solid lines. In printing these odd columns, the ratchet wheel 321 is selected and brought to rest by the left (FIG. 5*a*) one 311 of the separated ends 311, 312 of the selective pawl 31 to select a character for printing. A platen-roller 33 presses on the characters through a recording paper 34 and causes printing on the paper 34. Though inking means is not illustrated, the printing is done by means of a ribbon positioned between the characters and the paper 34 or by means of an ink roller.

When this printing action is completed, the cam 35 has turned half of a revolution so as to move the drive shaft 36 laterally to the right (FIG. 5*a*) by a distance of one column spacing. Now, the character rings 30 are positioned so that even columns, that is, columns 2, 4, 6, etc., can be printed. The character rings 30, and the drive shaft 36 to which the character rings 30 are connected, translate to the position 30' indicated in the drawings with broken lines. When completion of the translation is confirmed by a detector (not shown), the motor gear 37 rotates the shaft 36' through the intermediate gear 60' and the process of selecting a character on each print ring 30' beings. The spring 67, which is compressed when the shaft 36 translates laterally, constantly urges the end of the shaft 36 against the contours of the cam 35.

The cam 35 of FIGS. 5*a* and 5*b* is contoured for translation through a single columnar spacing. The pawl 31 remains stationary as the shaft 36 with the character rings 30 translates, such that when printing the odd columns, the ratchet wheel 321 is engaged by the pawl arm 311 and when printing the even columns the pawl arm 312 is engaged with the ratchet 322.

After a desired character is selected on each character ring 30', the characters are printed by the platen roller 33 and printing of one line is completed by the above-described two-step action. Then paper feeding, ribbon transport, etc., are performed in a known manner which needs no further description here as it does not constitute a novel portion of this invention. In this embodiment, the character rings 30 are constructed to move only between two columnar positions. But, by application of the principles of this invention, a character ring can be moved for three, four or more columns by changing the shape of the cam 35, or other translating mechanism which may be used. In this way, characters for a plurality of columns can be printed easily by one character ring having only a single band of characters on its periphery.

Figure 6:
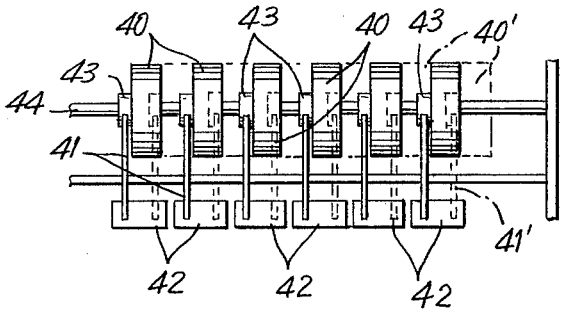
FIG. 6 is an alternative embodiment of a character ring-selecting type printer in accordance with this invention.
Figure 7:
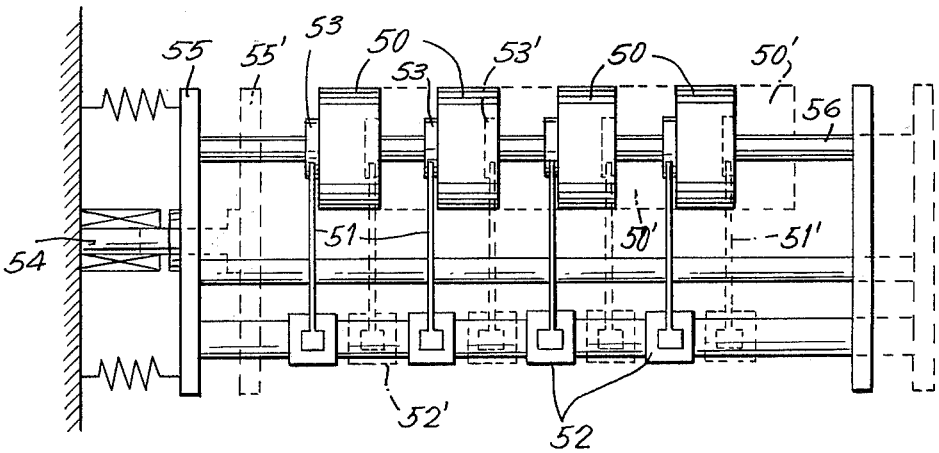
FIG. 7 is another alternative embodiment of a character ring-selecting type printer in accordance with this invention.

FIG. 6 is an alternative embodiment of this invention, showing a structure wherein the character rings 40 and the selective pawls 41 translate together. However, the electro-magnets 42 are fixed in position. Ratchet wheels 43 are affixed to only one side of each character ring 40 and the pawl member 41 has only one extension to engage with the teeth of the ratchet wheel 43. Other details of construction are similar to those illustrated in FIGS. 3*a*, 3*b* and 4, and the character rings 40 are mounted on a drive shaft 44. The character rings 40 rotate with the drive shaft 44, as described above, until a selection of a character for printing has been made. The number of character rings 40 is defined as m/2 where m is the total number of columns to be printed. Also, the number of selective pawls 41 is m/2, that is, there is one pawl for each character ring. Each selective pawl 41 is positioned so as to be actuated by an individual electro-magnet 42 even in the condition where the ring and associated pawl are translated, as indicated by the reference numerals, 40', 41' respectively, to print the adjacent columns. Translation is produced by a cam mechanism 35, or as shown in FIG. 7, and described hereinafter. As described with reference to FIG. 5*a*, after the character rings print in the positions indicated by the solid lines, the character rings 40 and the associated pawls 41 translate laterally to the positions shown by the broken lines and given prime (') reference numerals. Then characters are printed at the translated position before the assembly returns to its initial condition. Thus, in two steps m/2 character rings 40 print m columns of characters on a paper.

FIG. 7 is another alternative embodiment of a character ring-selecting type printer in accordance with this invention, wherein the primary mechanism necessary for printing, that is, a character ring 50, a selective pawl 41, an electro-magnet 52 and associated mechanisms, are unified for simultaneous lateral translation. An electro-magnetic solenoid 54 has its plunger rigidly attached to a frame 55 to which a drive shaft 56 is mounted. In the manner described above, the character rings 50 are mounted to the drive shaft 56. When the solenoid 54 attracts the frame 55 to the left, (FIG. 6), the character rings 50 are in the position represented by the solid lines and odd columns are printed. When the frame 55 is repelled by the solenoid 54, the frame with the drive shaft 56, character rings 50, pawls 53, drive magnets 52, etc., translate as a unit such that the even columns may be printed on a paper (not shown) by the character rings now located in the positions identified as 50'.

Thus, three embodiments, in accordance with this invention, have been described. In each embodiment, the character rings are translated such that spaced-apart character rings are used to print more than one column. In the embodiment of FIG. 5*a*, the character rings 30 translate but the pawl devices 31 remained laterally stationary. In the embodiment of FIG. 6, character rings 40 and pawl mechanisms 41 translate in unison. In the embodiment of FIG. 7, character rings 50, pawl mechanisms 51 and the driving electro-magnets 52 move in unison.

The character rings used in the three described embodiments, in accordance with this invention, incorporate the components requiring accuracy in manufacture and assembly. However, as there is a wide space between each character ring in the printers in accordance with this invention, dimensional variations in the lateral direction may occur without influencing the mechanism for the adjacent column. Thus, the difficulties encountered where character rings for adjacent printed columns are immediately adjacent to each other, are avoided. By eliminating half of the character rings which would otherwise be used, the printer in accordance with this invention eliminates parts which are complicated and require high accuracy in manufacture and assembly. Also, the space between character rings produces a printer which can tolerate reasonable lateral variation in each part. Because it also prints with a rolling, pressing motion, as described above, the printer is quiet in operation.

The embodiments described above incorporate character rings for printing every other column in what is intended to be a continuous line of printed columns. However, other embodiments of character ring-selecting type printers will fall within the scope of this invention. For example, in an alternative embodiment, similar to that of FIG. 5*a*, the ratchet wheel 321 may be of extended lateral width such that the ratchet wheel 322 and the pawl arm 312 can be eliminated from the construction. The pawl arm 311 remains positioned for engagement with the extended width ratchet 321 when the cam 35 produces translation. Further, it should be understood, in another alternative embodiment, that the cam 35 may provide n levels of driving surfaces such that a character wheel 30 may print 2, 3 ... n columns and the number of character rings 30 which are required for a given width of printing paper may be further reduced.

Also, in another alternative embodiment of this invention, it should be understood that character rings similar to those illustrated in FIG. 1 may also be used. In such an embodiment P2 and P4 of FIG. 1 are absent and each remaining drum P1, P3, after printing five columns is translated, as described in the embodiments in accordance with this invention, to print an additional five columns from each drum.

It will thus be seen that the objects set forth above among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a character ring-selecting type printer including a plurality of character rings mounted for rotation about a common axis, each of said character rings having characters on the periphery thereof for printing on the surface of a printing medium; means for rotationally driving said character rings; means for stopping said rotational driving of said character rings individually at selected positions; pressing means for pressing on said character rings for printing after said selection and cessation of said rotational driving, the improvement therein comprising:

lateral spacing between said character rings;

means for translating at least two of said plurality of character rings in unison, said translation being in the direction of said lateral spacing parallel to said common rotational axis of said character rings;

means for selectively and individually actuating said individual stopping means, said stopping means and said associated actuating means being moved laterally in unison with said associated character ring by said translating means, whereby a process of character selection and printing is performable at at least two lateral positions of said at least two character rings and the number of printable columns exceeds the number of said character rings.

2. The character ring-selecting type printer as claimed in claim 1, wherein said means for lateral translation translates said at least two character rings over a lateral distance at least equaling the center line distance between adjacent printable columns for printing on said printing surface.

3. The character ring-selecting type printer, as claimed in claim 2, wherein said lateral spacing between said character rings equals the center line distance between adjacent printed columns and the number of character rings is one half of the number of printable columns.

4. In a character ring-selecting type printer including a plurality of character rings mounted for rotation about a common axis, each of said character rings having characters on the periphery thereof for printing on the surface of a print medium; means for rotationally driving said character rings; means for stopping said rotational driving of said character rings individually at selected positions; pressing means for pressing on said character rings for printing after said selection and cessation of said rotational driving, the improvement therein comprising:

lateral spacing between said character rings;

means for translating at least two of said plurality of character rings in unison, said translation being in the direction of said lateral spacing parallel to said common rotational axis of said character rings, said character rings translate independently of said means for stopping, said means for stopping being laterally fixed in position, whereby a process of character selection and printing is performable at at least two lateral positions of said at least two character rings and the number of printable columns exceeds the number of said character rings.

5. The character ring-selecting type printer, as claimed in claim 4, and further comprising a first ratchet wheel integral with each said character ring and rotating therewith, wherein said means for stopping said character rings includes a pawl for each said character ring mounted for selective engagement with said ratchet wheel; and means for selectively driving said pawl into engagement with said first ratchet wheel, whereby rotation of said character ring is stopped at a selected position for printing.

6. The character ring-selecting type printer, as claimed in claim 5, wherein said means for selectively driving said pawl include a magnetic device.

7. The character ring-selecting type printer, as claimed in claim 5, wherein said pawl includes at least two parallel arms and further comprising a second ratchet wheel integral with each said character ring, one said arm cooperating with said first ratchet wheel to stop said character ring when at a first lateral position, the other said arm cooperating with said second ratchet wheel to stop said character ring when at a second lateral position, whereby a single laterally fixed pawl cooperates with the associated character ring at more than one lateral position of said character ring.

8. In a character ring-selecting type printer including a plurality of character rings mounted for rotation about a common axis, each of said character rings having characters on the periphery thereof for printing on the surface of a print medium; means for rotationally driving said character rings; means for stopping said rotational driving of said character rings individually at selected positions; pressing means for pressing on said character rings for printing after said selection and cessation of said rotational driving, the improvement therein comprising:

lateral spacing between said character rings;

means for translating at least two of said plurality of character rings in unison, said translation being in the direction of said lateral spacing parallel to said common rotational axis of said character rings, and further comprising means for selectively actuating said stopping means, wherein said stopping means moves laterally with said character ring, said means for selectively actuating said stopping means being laterally fixed in position, whereby a process of character selection and printing is performable at at least two lateral positions of said at least two character rings and the number of printable columns exceeds the number of said character rings.

9. The character ring-selecting type printer, as claimed in claim 1, 2 or 8 wherein said means for stopping said character rings includes for each said character ring; a first ratchet wheel intergral with said character ring and rotating therewith; a pawl, said pawl being mounted for selective engagement with said ratchet wheel; and said means for selectively actuating driving said pawl into engagement with said first ratchet wheel, whereby rotation of said character ring is stopped at a selected position for printing.

10. The character ring-selecting type printer, as claimed in claim 9, wherein said means for selectively actuating includes an electro-magnet, said electro-magnet and said stopping means moving laterally in unison with said associated character ring.

11. The character ring-selecting type printer, as claimed in claim 9, wherein said means for selectively actuating include a magnetic device.

12. The character ring-selecting type printer, as claimed in claim 1, 4 or 8, wherein said means for translating includes a cam surface.

13. The character ring-selecting type printer, as claimed in claim 1, 4 or 8, wherein said means for translating includes an electro-magnetic device.

14. The character ring-selecting type printer, as claimed in claim 8, wherein said laterally fixed means for selectively actuating each said stopping means includes an electro-magnet said electro-magnet cooperating with said pawl at every lateral position of said character ring for printing.

* * * * *